United States Patent [19]

Florentine, Sr.

[11] Patent Number: 4,529,235

[45] Date of Patent: Jul. 16, 1985

[54] DOOR BOLTING DEVICE

[76] Inventor: Henry P. Florentine, Sr., 1564 Tremone St., Boston, Mass. 02120

[21] Appl. No.: 657,039

[22] Filed: Oct. 2, 1984

Related U.S. Application Data

[63] Continuation-in-part of Ser. No. 394,667, Jul. 2, 1982.

[51] Int. Cl.[3] ..... E05C 19/18

[52] U.S. Cl. ..... 292/258; 49/394; 292/259 R

[58] Field of Search ..... 70/14, 19; 292/258, 292/259, 260, 148, 251, 57, 68, 288, 289, DIG. 46; 411/171, 257, 376, 910, 82; 228/40; 49/394

[56] References Cited

U.S. PATENT DOCUMENTS

| | | | |
|---|---|---|---|
| 546,164 | 9/1895 | Knight | 292/259 |
| 705,529 | 7/1902 | Hicks | 292/148 X |
| 1,700,620 | 1/1929 | Yunek | 292/259 X |
| 1,942,732 | 1/1934 | Shepard | 292/259 |
| 2,707,507 | 5/1955 | Tripp et al. | 411/171 |
| 3,615,114 | 10/1971 | Harris | 292/288 |
| 3,724,130 | 4/1973 | Bogue | 292/259 X |
| 3,815,806 | 6/1974 | Paxton | 228/40 X |
| 3,819,216 | 6/1974 | Richardson | 292/259 |
| 3,821,884 | 7/1974 | Walsh | 292/259 X |
| 4,374,598 | 2/1983 | Scott | 292/259 |

*Primary Examiner*—Gary L. Smith
*Assistant Examiner*—Russell W. Illich
*Attorney, Agent, or Firm*—Robert T. Gammons

[57] ABSTRACT

A door bolting device for use with a door which has an empty cylinder hole and which is mounted in a doorframe having a doorjamb against one side of which a first of the door's two broad sides abuts when the door is closed. The device comprises a door-grabbing element which abuts against the second of the door's two broad sides; a jamb-grabbing element which abuts against the opposite side of the doorjamb from that which the door abuts when closed; and a connecting element which connects the door-grabbing element on the second broad side of the door to the jamb-grabbing element on the first broad side of the door through the cylinder hole, so that the door is held against the doorjamb. In a preferred embodiment, the door-grabbing element abuts not only the second broad side of the door but also a portion of the doorframe, and the jamb-grabbing element has a grabbing portion abutting against the doorjamb, a door-adjacent portion lying adjacent to the side of the door with an opening positioned over the cylinder hole, and a jamb-front abutting portion extending adjacent to a front surface of the doorjamb located between the door and the grabbing portion of the jamb-grabbing element. In such a preferred embodiment, the connecting element extends from the door-grabbing element through the cylinder hole and the opening in the door-adjacent portion of the jamb-grabbing element, and includes an attaching element to prevent the door-grabbing element and the jamb-grabbing element from being pulled apart. In one preferred embodiment, the connecting element includes a threaded bolt and a nut and a washer which have been threaded onto that bolt and welded in place.

2 Claims, 8 Drawing Figures

DOOR BOLTING DEVICE

This application is a continuation-in-part, of application Ser. No. 394,667, filed July 2, 1982.

BACKGROUND OF THE INVENTION

1. Field of the Invention

The present invention relates to the bolting of doors, and, more particularly, to an apparatus which is particularly suited for keeping a door firmly bolted shut for a prolonged period of time and which will make such a bolted door resistant to the efforts of burglars and vandals to open it.

2. Description of the Prior Art

It is often desired to keep a door firmly shut for a prolonged period of time in such a manner that it will be resistant to the efforts of vandals and burglars to open it. For example, many public housing projects contain apartments which are vacated. When such an apartment is empty, it is desirable to keep the entrance to it firmly shut, so as to prevent vandals from entering and destroying property and to prevent burglars from entering and stealing fixtures or other items of value. Because ordinary locks are often found insufficient to prevent vandals and burglars from entering such apartments, it has been a practice in some housing projects in which apartments have metal frames and metal covered doors to spot weld the metal door surfaces to the metal frames in order to prevent undesired entrance through such doors. Although this method is highly successful at preventing unwanted intrusion, it unfortunatly damages the doorframes with which it is used.

Besides the spot welding method of securely shutting a door, mentioned above, the prior art has many other means for keeping doors shut. Unfortunately many of them are either unsuitable or insufficient for use in an environment such as that which occurs in certain public housing projects, in which vandals or burglars often use devices such as sledge hammers and crow bars in their efforts to obtain improper entrance through locked doorways. For example, U.S. Pat. No. 3,819,216, issued to Richardson, discloses a device for holding a door shut which comprises a bar designed to fit snugly against the doorjambs of a doorframe and against one broad side of a door placed in that doorframe. This bar has legs which are designed to fit into channels contained within brackets mounted by bolts that extend through the door, so as to hold the bar firmly against the door. The bar has doorjamb catching portions which prevent the door from being opened once the bar is in place. One disadvantage of this door bolting scheme is that its use of bolts which extend through the door results in permanent alteration of the door and requires considerable time and effort in installation.

Another device for holding a door shut is disclosed in U.S. Pat. No. 3,980,328, issued to Pearson. This patent discloses a flat bar, two brackets at each side of the doorframe for holding the bar across the door over its doorknob, and a doorknob grabbing structure attached to the bar for hooking on to the doorknob and holding it so that the door cannot be opened. Although this device has the advantage that it does not require any alteration of the door to which it is attached, it has the disadvantage of requiring that braces be attached to the doorframe with which it is used, and it also would appear to have the disadvantage of being relatively easily broken by burglars or vandals.

U.S. Pat. No. 3,919,807, issued to Mefford, discloses a door locking device which includes an elongated rail rotatably mounted at one side of a doorframe so that it can be rotated across that doorframe. The rail has a projection which is designed to extend into a locking device contained within the door, so that the door can be locked to the rail, preventing the door from opening in an unwanted manner. Although such a device appears to have many advantages, it has the disadvantages of requiring that a special locking device be mounted in the door with which it is used, and of its rail being mounted in or near the doorframe with which it is to be used, and it appears to be a device which could be relatively easily broken by burglars or vandals.

OBJECTS OF THE INVENTION

Accordingly, it is an object of this invention to provide a door bolting device that avoids the above-mentioned difficulties encountered with the prior art.

It is another object of the invention to provide a door bolting device which is highly resistant to improper efforts to open a door which it has bolted shut.

It is a further object of this invention to provide a door bolting device which can be installed with very little or no permanent damage to the door which it bolts shut.

It is yet another object of the invention to provide a door bolting device which can be installed or removed with relative ease.

The above and other objects, features, and advantages of the present invention will become readily apparent from the ensuing detailed description, and novel features of the invention will be particularly pointed out in the appended claims.

SUMMARY OF THE INVENTION

In accordance with one aspect of this invention, a door bolting device is provided for use with a door which has an empty cylinder hole and which is mounted in a doorframe having a doorjamb against one side of which doorjamb a first of the door's two broad sides abuts when the door is closed. The door bolting device comprises door-grabbing means for abutting against the second of the door's two broad sides, jamb-grabbing means for abutting against the opposite side of the doorjamb from that which the door abuts when closed, and connecting means for connecting the door-grabbing means on the second broad side of the door to the jamb-grabbing means on the first broad side of the door through the cylinder hole, once the door has been closed, so that the door is held against the doorjamb by the door-grabbing means and the jamb-grabbing means.

In a preferred embodiment, the door-grabbing means is a rigid plate of a sufficient size and shape so that it abuts not only against the second broad side of the door, but also against a portion of the doorframe. In such a preferred embodiment the jamb-grabbing means includes a grabbing portion, a door-adjacent portion, and a jamb-front abutting portion. The grabbing portion is for abutting against the opposite side of the doorjamb from that which the closed door abuts. The door-adjacent portion is for lying adjacent to the first broad side of the door and for being connected by the connecting means to the door-grabbing means through the cylinder hole. The jamb-front abutting portion is for extending in the direction of the length of the doorjamb adjacent to a front surface of the doorjamb located between the side of the doorjamb against which the door abuts when closed and the side of the doorjamb against which the grabbing portion abuts. This jamb-front abutting portion prevents the grabbing portion of the jamb-grabbing means from being rotated away from the doorjamb when the door-adjacent portion is connected through the cylinder hole to the door-grabbing means. In such a preferred embodiment the door-adjacent portion defines an opening positioned to lie over the cylinder hole and the connecting means includes an extending means for extending from the door-grabbing means and through the cylinder hole and the opening in the door-adjacent portion. The connecting means also includes an attaching means for attachment to the extending means and for abutting against the door-adjacent portion to prevent the extending means and the door-grabbing means from being pulled away from the jamb-grabbing means. In one embodiment, the extending means is the threaded shaft of a bolt, and the attaching means is comprised of a nut and a washer which are threaded onto the end of the bolt and then welded in place. In another embodiment of the invention the extending means includes a bar having a padlock hole near its end, and the attaching means is comprised of a padlock.

In one form of the invention, the jamb-grabbing means extends between two opposing sides of the doorframe and is designed to abut against the doorjamb located on each of those opposite sides. In a different form of the invention, the jamb-grabbing means abuts against only one doorjamb.

BRIEF DESCRIPTION OF THE DRAWINGS

The following detailed description, given by way of example, would best be understood in conjunction with the accompanying drawings, in which.

DETAILED DESCRIPTION OF PREFERRED EMBODIMENTS

Figure 1:
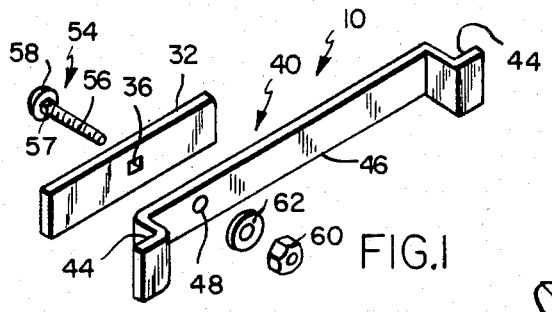
FIG. 1 is an exploded perspective view of a door bolting device according to one embodiment of the present invention.
Figure 2:
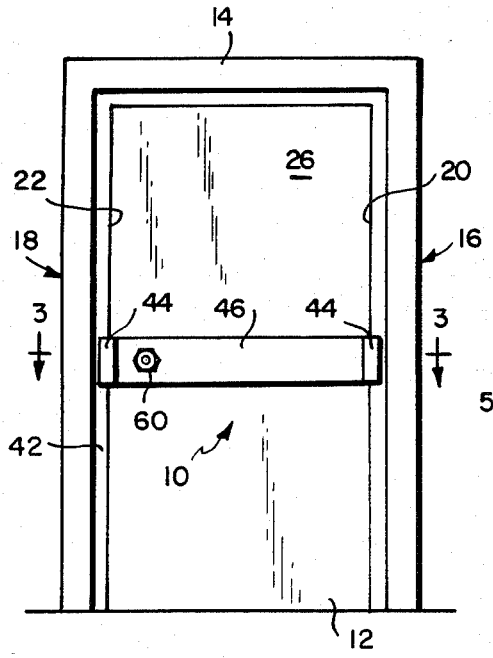
FIG. 2 is a front view of a door which has been bolted to its doorframe by means of the door bolting device shown in FIG. 1.
Figure 3:
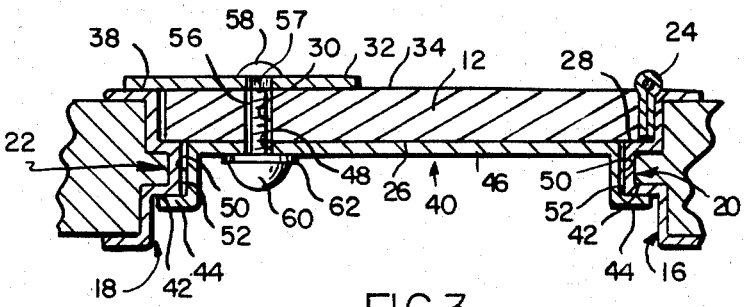
FIG. 3 is a cross section of the door, doorframe, and door bolting device shown in FIG. 2 taken along the line 3—3 shown in FIG. 2.

Referring to FIGS. 1–3, a door bolting device 10 according to one embodiment of the present invention is shown. Door bolting device 10 is designed for use with a door 12 which is mounted in a doorframe 14 having a first doorframe side 16 and a second, opposing, doorframe side 18. Two opposing doorjambs 20 and 22 are located on the opposing doorframe sides 16 and 18, respectively. The door 12 is mounted on hinges 24 located on the first doorframe side 16. The door is hinged in such a manner that when it is closed a first of its two broad sides, side 26, abuts a first side 28 of each of the two doorjambs 20 and 22. In most apartments this side 26 which abuts doorjambs 20 and 22 is the outside side of the door and faces out of the apartment that the door opens into. Door bolting device 10 is designed for use with a door 12 having an empty cylinder hole 30 which is nearer to the second doorframe side 18 than to the first doorframe side 16 when door 12 is closed. In this application and the claims that follow, the phrase "empty cylinder hole" refers to a hole which has been placed through a door to make room for the insertion of a cylinder lock or a doorknob actuated lock or latch. The hole may be empty either because such a cylinder lock or doorknob actuated apparatus has not yet been inserted, or because such a cylinder lock or doorknob actuated apparatus has been removed so as to make possible use of the door bolting device of the present invention.

Door bolting device 10 includes a door-grabbing means 32 for abutting against the second of door 12's two broad sides, side 34. In a preferred embodiment, door-grabbing means 32 is comprised of a length of three-inch by three-eighths-inch steel plate. This plate 32 has a square plate hole, or bolt hole, 36 for being placed over empty cylinder hole 30. The door-grabbing means 32 is of a sufficient size so that when its plate hole 36 is placed over the cylinder hole 30 with its longest dimension placed horizontally, it will overlap the edge of the second broad side 34 of the door 12 and rest adjacent to a portion 38 of the second side 18 of the doorframe. In other embodiments, the door-grabbing means 32 may be made of a circular plate having a diameter approximately equal to the length of the longest dimension of the plate 32 shown in FIGS. 1, 3, 4, and 8. This would insure that the door-grabbing means would overlap a portion 38 of the door frame regardless of its angular orientation.

Door bolting device 10 also includes a rigid jamb-grabbing means 40 which, in a preferred embodiment, is for abutting against the opposite side 42 of each of the doorjambs 20 and 22 from the side 28 of those doorjambs against which the door 12 abuts when closed. Jamb-grabbing means 40 has two grabbings portions 44, each of which corresponds to one of the doorjambs 20 and 22, and each of which abuts against the side 42 of its corresponding doorjamb to prevent jamb-grabbing means 40 from being pulled through the doorway. Jamb-grabbing means 40 also includes a door-adjacent portion 46 for lying adjacent to the first broad side 26 of the door 12 in between the doorjambs 20 and 22. The door-adjacent portion defines an opening 48 which is positioned to lie over the cylinder hole 30 when the jamb-grabbing means 40 is in place against door 12. Jamb-grabbing means 40 also includes two jamb-front abutting portions 50, one corresponding to each of the doorjambs 20 and 22. Each of the jamb-front abutting portions 50 extends in the direction of the length of its corresponding doorjamb, which is along the length of the doorframe side to which that doorjamb is attached. Each of these jamb-front abutting portions extends adjacent to a front surface 52 of its corresponding doorjamb between the side 28 of that doorjamb against which the door 12 abuts when closed and the opposite side 42 of the doorjamb against which the grabbing portions 44 abut. The jamb-front abutting portions 50 are designed to fit relatively snugly against the doorjambs 20 and 22. Because of their snug fit against their doorjambs and because they extend along the length of the doorjambs, the jamb-front abutting portions 50 prevent jamb-grabbing means 40 from being rotated about the cylinder hole 30 through which the jamb-grabbing means is fixed in place, as is discussed below. This prevents the grabbing portions 44 of the jamb-grabbing means 40 from being rotated away from the sides 42 of the doorjambs once the door-adjacent portion 46 is connected through the cylinder hole, as is described below.

A bolt 54 is provided as a connecting means for connecting door-grabbing means 32, placed on side 34 of door 12, to jamb-grabbing means 40, placed on side 26 of door 12, through cylinder hole 30, once door 12 has been closed, so that door 12 is held against doorjambs 20 and 22 by door-grabbing means 32 and jamb-grabbing means 40. Bolt 54 has a shaft 56 for extending from door-grabbing means 32 through and past cylinder hole 30 and the opening 48 in the jamb-grabbing means 40. Bolt 54 also has a head 58, which is larger in diameter than bolt hole 36, for pulling door-grabbing means 32 against side 34 of door 12 when bolt 54 is properly connected to jamb-grabbing means 40. A nut 60 comprises an attaching means for attachment to shaft 56 of bolt 54 and for abutting against door-adjacent portion 46 of jamb-grabbing means 40 so as to prevent bolt 54 and door-grabbing means 32 from being pulled away from the jamb-grabbing means 40. A washer 62 is provided for placement between nut 60 and the surface of door-adjacent portion 46.

The door bolting device shown in FIGS. 1–3 is applied to a door in the following manner. First it is necessary to make sure that the door has empty cylinder holes. If a door is brand new it is possible that its cylinder hole or holes will not have yet been filled with a cylinder lock or a doorknob actuated locking or latching device. In this case, such an unfilled cylinder hole is ready for use. But in the more common case, it will be necessary to remove a cylinder lock or doorknob actuated latching or locking device from a door in order for it to be used with the door bolting device of the present invention. Once a cylinder hole has been emptied, the bolt 54 is placed through the hole 36 of the door-grabbing plate 32. The shaft 56 of the bolt 54 has a portion 57, which is square in cross section, located near its intersection with the head 58 of that bolt. This square portion 57 is designed to fit into the hole 36, which is also square, to prevent plate 32 from rotating relative to bolt 54. Once bolt 54 has been inserted into plate 32 so as to prevent rotation between the two, the portion of the bolt shaft 56 which extends through and past plate 32 should be placed through empty cylinder hole 30. The portion of bolt shaft 56 which sticks through cylinder hole 30 should be pulled firmly so that plate 32 is pressed against side 34 of door 12. Plate 32 should be oriented at this time so that it is placed in a generally horizontal position, with a portion of its surface sticking out over the edge of the side 34, so that when door 12 is closed, part of plate 32 will abut against a portion 38 of the doorframe. At this time door 12 should be pulled shut and jamb-grabbing means 40 should be placed against doorjambs 20 and 22 and side 26 of door 12, as is shown in FIG. 3. The jamb-grabbing means 40 should be placed so that the bolt shaft 56 extends through the opening 48 of the door-adjacent portion 46. Then washer 62 and nut 60 should be placed on the threaded bolt shaft 56 and tightened into place so that bolt head 58 firmly pushes door-grabbing plate 32 against door 12 and portion 38 of the doorframe and so that nut 60 and washer 62 firmly push jamb-grabbing means 40 against the sides 42 of the doorjambs 20 and 22 and door-adjacent portion 46 toward the door 12. Once this is done a welding torch should be used to weld nut 60 both to washer 62 and to the tip of bolt shaft 56. This will make it impossible for vandals or theives to unscrew nut 60 and will tend to make washer 62, nut 60 and the tip of bolt shaft 56 into a relatively smooth round knob on which it is difficult to obtain a firm mechanical hold.

When it is desired to open a door which has been bolted by means of the door bolting device 10 on which a nut 60 has been welded to bolt shaft 56, it is necessary to use a welding torch to burn off nut 60 and washer 62. Experiments have shown that with such a welding torch it is easy to burn off the welded nut 60, the washer 62, and the tip of the bolt shaft 56, leaving the remainder of door bolting device 10 in good condition for future use.

Figure 4:
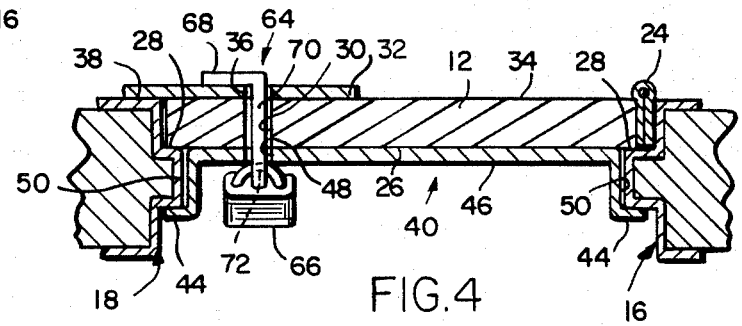
FIG. 4 is a cross section of a door, doorframe, and door bolting device which is identical to that of FIG. 3, except that the connecting means shown in that figure is different from that shown in FIG. 3.

Referring to FIG. 4, an alternate embodiment of the invention is shown which is identical to that shown in FIGS. 1–3 except for the fact that bolt 54, nut 60 and washer 62 have been replaced by a connecting device comprised of an L-shaped bar 64 and a padlock 66. The L-shaped bar 64 has a head portion 68 for abutting against the door-grabbing plate 32 in a manner similar to that of the head 58 of bolt 54 shown in FIGS. 1–3. L-shaped bar 64 also has an extending portion 70 for extending through and past plate hole 36, cylinder hole 30 and opening 48 in door-adjacent portion 46. A padlock hole 72 is located near the end of the extending portion 70 where that end sticks out beyond the door-adjacent portion 46. A padlock 66 can be placed through this hole so as to abut against the door-adjacent portion 46 and thus securely hold door-grabbing plate 32 and jamb-grabbing means 40 tightly together with the door 12 held firmly in between. The door bolting device shown in FIG. 4 is slightly less secure than that shown in FIGS. 1–3, but it has the advantage of not requiring the use of a welding torch for assembly or disassembly, and thus it is quicker and more convenient to use. Thus the door bolting device shown in FIG. 4 is especially advantageous when it is desired to bolt a door on a temporary basis, for example, while waiting to obtain a welding torch.

Figure 7:
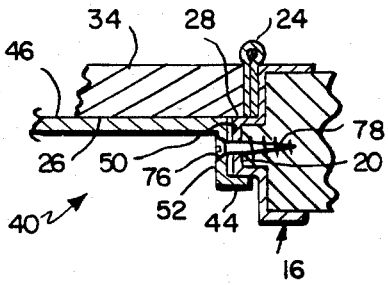
FIG. 7 is a portion of a cross section similar to that shown in FIGS. 3 and 4 which shows another modification of the invention.
Figure 5:
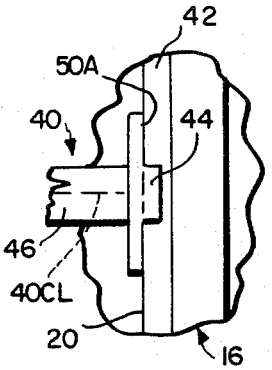
FIGS. 5–6 are a partial front view showing modifications of the door bolting devices of FIGS. 1–4.
Figure 6:
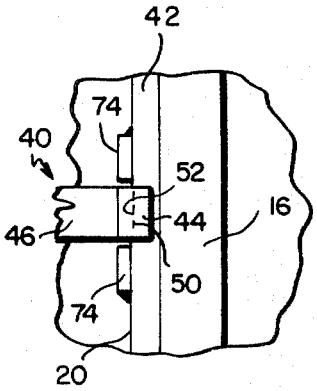

FIGS. 5–7 reveal modifications suitable for use with embodiments of the invention similar to those shown in FIGS. 3 and 4. All three of the modifications shown in FIGS. 5–7 are for the purpose of increasing the firmness with which the end of the jamb-grabbing means furthest away from cylinder hole 30 is held in place against its corresponding doorjamb 20. In the modification shown in FIG. 5, the jamb-front abutting portion 50A which corresponds to the doorjamb 20 on the side 16 of the doorframe, that is the side of the doorframe which is furthest from cylinder hole 30 when door 12 is shut, extends further in the direction of the length of its corresponding doorjamb than the width of the door-adjacent portion 46 of jamb-grabbing means 40. This extra length of the jamb-front abutting portion greatly reduces the tendency of jamb-grabbing means 40 to rotate about its connection through cylinder hole 30 to the door-grabbing means 32. This is because the further a portion of the surface of the jamb-front abutting portion 50A is from the center line 40CL (shown by a dotted line), of the jamb-grabbing means 40, the greater is its distance from the cylinder hole 30 about which the jamb-grabbing means is mounted. Therefore any rotation of the jamb-grabbing means will tend to push those further removed portions of surface 50A firmly against jamb 20 to prevent further such rotation.

FIG. 6 shows another modification of the invention in which protruding means 74 are provided which stick out from the doorjamb 20 on side 16 of the doorframe, one above and one below the jamb-front abutting portion 50 which correspond to the doorjamb 20. These protrusions physically block the rotation of the jamb-grabbing means 40 relative to the cylinder hole 30 once the door bolting apparatus has been assembled about a closed door, and thus insure that the grabbing portions 44 of the door-grabbing means stay in the desired location so as to firmly grab the doorjambs over which they are placed. The protruding means 74 can easily be constructed by spot welding small plates of steel into place above and below the jamb-grabbing means 40.

FIG. 7 shows a third modification for securely holding in place the end of the jamb-grabbing means 40 which is furthest removed from cylinder hole 30. In this modification the jamb-front abutting portion 50 which corresponds to the doorjamb 20 contains a fastening hole 76 for enabling that jamb-front abutting portion to be fastened to doorjamb 20 by means of a fastening device such as a screw 78 which is placed through hole 76 and into doorjamb 20.

Figure 8:
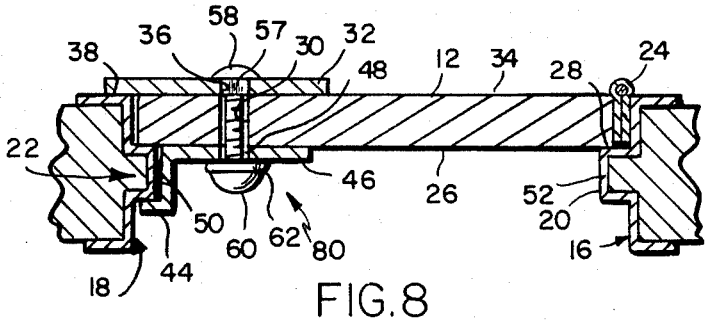
FIG. 8 is a cross section similar to that of FIGS. 3 and 4 showing still another embodiment of the invention.

Referring now to FIG. 8, an alternate embodiment of the door bolting device of the present invention is shown which is identical to that shown in FIGS. 1–3 except for the fact that its jamb-grabbing means 80 does not extend all the way toward side 16 of the doorframe, nor does it have any grabbing portions for overlapping the doorjamb 20 which is located on that side of the doorframe, as does the jamb-grabbing means 40 shown in FIGS. 1–7. The door bolting device shown in FIG. 8 is virtually as secure as the door bolting devices shown in FIGS. 1–7, even though it may not appear quite as forbidding. This is true because the hinges 24 located on the other side of the door 12 are normally quite strong, making the door very resistant to efforts to kick the hinged side of the door away from the doorframe. This is particularly true if the door 12 is a steel covered door, as are many apartment doors in public housing projects. Indeed, if the jamb-grabbing means 80 is properly designed with a jamb-front abutting portion 50 which extends for a sufficient length in the direction of the length of the doorjamb 22 and which fits snugly into that doorjamb so that the jamb-grabbing means is prevented from rotating about cylinder hole 30, and if the grabbing portion 44 is shaped so as to get a good hold against the doorjamb 22, the door bolting device shown in FIG. 8 will prove highly resistant to unwanted entry.

Thus it can be seen that the present invention provides a simple and easy to use means for securely bolting doors which does not require the permanent defacing of that door, but which merely requires that a cylinder lock or doorknob actuated latching or locking device be removed from the door so as to provide an empty cylinder hole.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention defined in the following claims.

What is claimed is:

1. In combination with a door frame comprising spaced, parallel doorjambs having opposed facing sides defined by first transversely-spaced inner and outer planar surfaces and intermediate planar surfaces protruding from the first transversely-spaced inner and outer planar surfaces and defining therewith second spaced, parallel inner and outer planar surfaces at right angles to the first spaced, parallel inner and outer planar surfaces and the intermediate planar surfaces, a door containing an opening for receiving a lock cylinder positioned in the opening defined by the first inner planar surfaces with one side engaged with the second inner planar surfaces, hinge means hingedly connecting one edge of the door to one of the first inner planar surfaces, a first rigid bar having a flat part engaged with said one side of the door at the side opposite the hinge means, a part at right angles thereto engaged with the intermediate planar surface at that side and a part at right angles to the latter part engaged with the second outer planar surface, said rigid bar containing an opening in registration with the opening in the door which normally receives the lock cylinder, a second rigid bar engaged with the opposite side of the door with an end overlapping the doorjamb at that side and containing an opening in registration with the lock cylinder opening and bold means securing the two bars to each other through the lock cylinder opening.

2. The combination according to claim 1 wherein the first rigid bar has at the opposite end a part at right angles thereto engaged with the intermediate planar surface at that side and a part at rigid angles to the latter part engaged with said outer planar surface at that side.

* * * * *